United States Patent [19]

Del Corso et al.

[11] Patent Number: 4,891,080

[45] Date of Patent: Jan. 2, 1990

[54] WORKABLE BORON-CONTAINING STAINLESS STEEL ALLOY ARTICLE, A MECHANICALLY WORKED ARTICLE AND PROCESS FOR MAKING THEREOF

[75] Inventors: Gregory J. Del Corso; James W. Martin, both of Sinking Springs; David L. Strobel, Leesport, all of Pa.

[73] Assignee: Carpenter Technology Corporation, Reading, Pa.

[21] Appl. No.: 203,282

[22] Filed: Jun. 6, 1988

[51] Int. Cl.[4] ..... C22C 38/54; B22F 3/00

[52] U.S. Cl. ..... 148/326; 148/327; 75/244; 75/246; 376/339; 376/900; 419/12; 419/28; 419/49

[58] Field of Search ..... 148/326, 327, 12 E, 148/11.5 P, 2, 11 SP; 420/43, 64; 75/238, 244, 246; 419/12, 28, 49; 376/339, 900

[56] References Cited

U.S. PATENT DOCUMENTS

| | | | |
|---|---|---|---|
| 3,065,068 | 11/1962 | Dyrkacz et al. | 148/326 |
| 3,199,978 | 8/1965 | Brown et al. | 148/326 |
| 4,172,742 | 10/1979 | Rowcliffe et al. | 148/326 |

*Primary Examiner*—Deborah Yee

*Attorney, Agent, or Firm*—Dann, Dorfman, Herrell & Skillman

[57] ABSTRACT

A workable, boron-containing, stainless steel alloy and an article formed therefrom are disclosed together with a process for manufacturing same. The alloy consists essentially of, in weight percent, about

| | w/o |
|---|---|
| Carbon | 0.10 max. |
| Manganese | 2.00 max. |
| Silicon | 1.00 max. |
| Phosphorus | 0.045 max. |
| Sulfur | 0.010 max. |
| Chromium | 16.00–22.00 |
| Nickel | 10.00–15.00 |
| Molybdenum | 0–3.0 |
| Boron | 0.2–2.0 |
| Nitrogen | 0.075 max. |

and the balance consisting essentially of iron. The as-worked alloy in accordance with the invention is characterized by having a boride particle areal density per weight percent boron ($A_N$) defined by the relationship $$A_N \geqq 58{,}080-18{,}130\ (\%B).$$

The as-worked alloy of the invention is further characterized by having a Charpy V-notch impact strength (CVN) defined by the relationship $$CVN \geqq 85.917 \times e^{-1.20297(\%B)}.$$

20 Claims, 1 Drawing Sheet

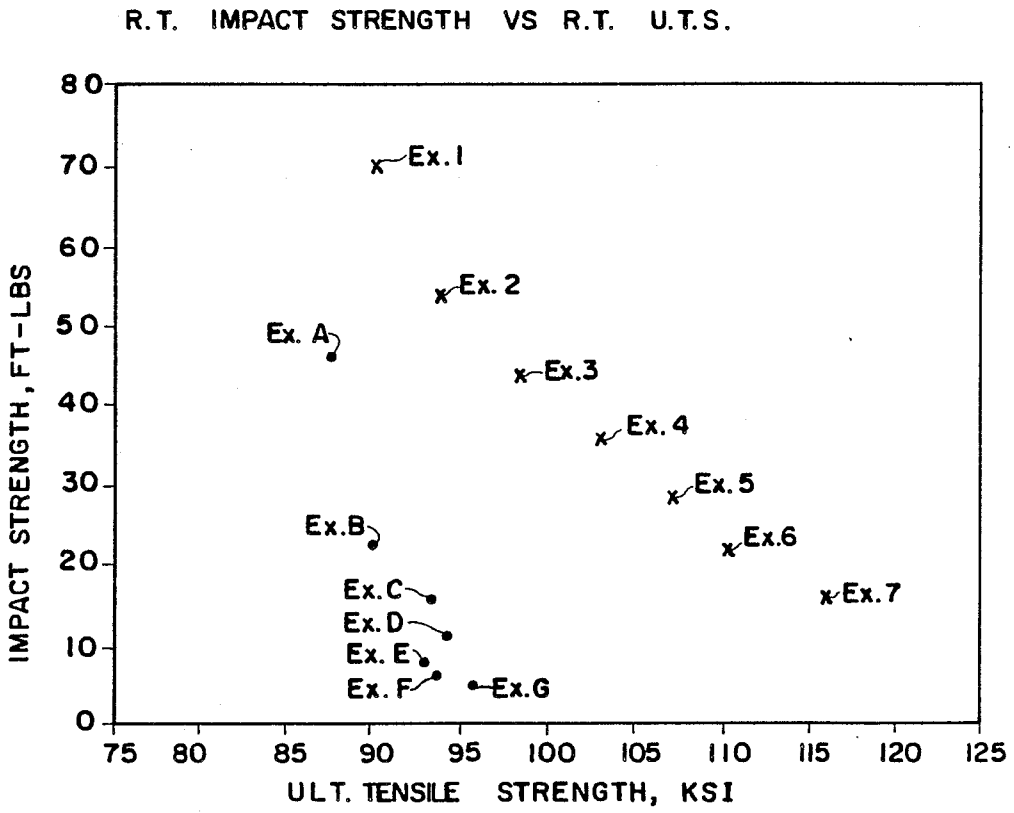
R.T. IMPACT STRENGTH VS R.T. U.T.S.
IMPACT STRENGTH, FT-LBS
0
10
20
30
40
50
60
70
80
ULT. TENSILE STRENGTH, KSI
75
80
85
90
95
100
105
110
115
120
125
Ex. 1
Ex. 2
Ex. 3
Ex. 4
Ex. 5
Ex. 6
Ex. 7
Ex. A
Ex. B
Ex. C
Ex. D
Ex. E
Ex. F
Ex. G

WORKABLE BORON-CONTAINING STAINLESS STEEL ALLOY ARTICLE, A MECHANICALLY WORKED ARTICLE AND PROCESS FOR MAKING THEREOF

BACKGROUND OF THE INVENTION

This invention relates to a boron-containing, austenitic stainless steel alloy and in particular to such an alloy and an article made therefrom which in addition to neutron absorption and corrosion resistance, has a unique combination of tensile ductility, strength and toughness such that the alloy is especially suited for making load-bearing, structural members.

Heretofore, an alloy of AISI type 304 stainless steel containing about 0.08% max. carbon, 2.00% max. manganese, 1.00% max. silicon, 0.045% max. phosphorus, 0.03% max. sulfur, 18.0–20.0% chromium, 8.0–10.5% nickel, 2.0% max. boron, and the balance essentially iron has been employed for making articles used in the nuclear power industry because of the good neutron absorption and corrosion resistance which the alloy provides. Here and throughout the specification and claims percent (%) will mean percent by weight unless otherwise specified. It is known that 1–2% boron benefits the tensile strength of the alloy, but also impairs the tensile ductility and toughness of the alloy. The presence of not more than about 1% boron in the alloy provides satisfactory ductility, but with a substantial sacrifice in neutron absorption capability. Accordingly, because of insufficient impact toughness and tensile ductility when the alloy contains more than 1% boron, it has not been found suitable for use in structural members or other load-bearing articles There has been a growing need for an alloy combining high impact toughness together with good corrosion resistance, strength and high neutron absorption for use as a structural material.

The present invention stems from the discovery that in the alloy of this invention, at each level of boron content the boron is present as complex borides, usually but not necessarily in the form of $M_2B$ type borides, and that when the quantity and distribution of the borides are controlled, as will be more fully described hereinbelow, a hitherto unattainable and unique combination of high strength, ductility, impact toughness and thermal neutron absorption at each level of boron is consistently obtained. Heretofore, it had been found that increasing boron in excess of 0.2% to improve neutron absorption was characterized by increases in difficulty and randomness with the result that a significant proportion of the material produced had marginal or less than desired mechanical properties. Thus, an important feature of the present invention results from the discovery that for a given level of boron in the alloy there is a readily determinable minimum normalized a real density ($A_N$) of the borides present therein which is characteristic of articles produced from the alloy and which ensures consistent attainment of the unique combination of neutron absorption, strength, ductility, impact toughness and corrosion resistance characteristic of the present invention.

It is a principal object of this invention to provide an alloy and article made therefrom having a unique and desirable combination of neutron absorption, corrosion resistance, tensile ductility, strength and impact toughness.

SUMMARY OF THE INVENTION

To a large extent the foregoing objective as well as additional objectives and advantages are realized by providing a workable austenitic stainless steel alloy, as well as a worked article made therefrom in accordance with this invention, which consists essentially of, in weight percent, about:

| | Broad | Intermediate | Preferred |
|---|---|---|---|
| C | 0.10 max. | 0.08 max. | 0.05 max. |
| Mn | 2.00 max. | 2.00 max. | 1.00–2.00 |
| Si | 1.00 max. | 0.75 max. | 0.2–0.75 |
| P | 0.045 max. | 0.045 max. | 0.025 max. |
| S | 0.010 max. | 0.005 max. | 0.002 max. |
| Cr | 16.00–22.00 | 16.00–22.00 | 18.00–20.00 |
| Ni | 10.00–15.00 | 10.50–15.00 | 12.00–15.00 |
| Mo | 0–3.0 | 2.5 max. | 0.5 max. |
| B | 0.2–2.0 | 0.5–1.8 | 0.7–1.6 |
| N | 0.075 max. | 0.03 max. | 0.015 max. |
| Fe | Bal. | Bal. | Bal. |

and the alloy as-worked having a boride particle areal density (no. of borides per $mm^2$) per weight percent boron ($A_N$) defined by the relationship $$A_N \geqq 58{,}080 - 18{,}130\ (\%\ B),$$ and a Charpy V-notch impact strength (CYN) defined by the relationship:

$$CVN \geqq 85.917 \times e^{-1.20297}(\%\ B).$$

Included with the balance (Bal.) are small amounts of other elements, including incidental impurities, which do not detract from the desired properties. For example, up to about 0.2% max., preferably about 0.1% max., cobalt, up to about 1% max., preferably not more than about 0.5% max. copper, up to about 0.2% max. tungsten and up to about 0.25% max. vanadium can be present. Furthermore, up to about 0.1% max. each of the elements aluminum, titanium, calcium, magnesium and up to about 0.1% max. misch metal can be present as residuals from deoxidizing and/or desulfurizing additions.

The foregoing tabulation is provided as a convenient summary. It is not intended thereby to restrict the lower and upper values of the ranges of the individual elements of the alloy used in the article of the present invention for use solely in combination with each other. Nor is it intended to restrict the broad, intermediate, or preferred ranges of the elements for use solely in combination with each other. Thus, one or more of the broad, intermediate and preferred ranges can be used with one or more of the other ranges for the remaining elements. In addition, a broad, intermediate or preferred minimum or maximum for an element can be used with the maximum or minimum for that element from one of the remaining ranges.

Here and throughout the specification and claims the term "boron" when it appears alone is used in its generic sense to include naturally occurring boron (which usually contains about 18% boron-10, an isotope of boron), natural boron enriched with boron-10, or boron-10. The boron-10 isotope has a substantially higher neutron absorption cross-section than natural boron.

BRIEF DESCRIPTION OF THE DRAWING

The drawing is a graph of room temperature impact strength vs. room temperature tensile strength for various examples of material prepared in accordance with the invention and for other examples which were not prepared in accordance with this invention.

DETAILED DESCRIPTION OF THE INVENTION

The alloy of the present invention includes boron to provide good absorption of thermal neutrons. A substantial amount of the boron is present in the form of $M_2B$ boride precipitates in the austenitic matrix of the alloy because of the low solubility of boron in this alloy. The M represents elements such as chromium and iron and can include some manganese and nickel. The resulting size and distribution of the boride precipitates after the alloy has been worked are distinctive features of this invention as will be explained more fully hereinbelow. Although the presence of the boride precipitates is beneficial to the tensile strength of the alloy, the impact strength and tensile ductility are adversely affected with increasing boron content. Accordingly, the alloy contains about 0.2–2.0%, better yet about 0.5–1.8%, and preferably about 0.7–1.6% boron. The best combination of mechanical properties is provided with about 1.0–1.25% boron.

Nickel contributes to the formation of austenite in the alloy and stabilizes it against transformation to martensite and ferite. Nickel also provides general corrosion resistance to acidic environments. Hence, at least about 10.00%, better yet at least about 10.50%, and preferably at least about 12.00% nickel is present. Too much nickel adds significantly to the expense of the alloy without providing a commensurate benefit. Consequently, nickel is limited to no more than about 15.00%.

Chromium provides oxidation and corrosion resistance and stabilizes the alloy against martensitic transformation. Chromium also readily combines with boron to form the aforementioned boride precipitates. Therefore a substantial portion of the chromium can be depleted from the alloy matrix depending upon the amount of borides present. Accordingly, at least about 16.00%, preferably at least about 18.00% chromium is present. Chromium is also a strong ferrite forming element and thus is limited to no more than about 22.00%, preferably to no more than about 20.00% in order to avoid ferrite formation.

Up to about 2% max. manganese is present in the alloy for tying up undesirable elements such as sulfur. Manganese, however, is limited to the stated amount in order to avoid formation of excessive oxide inclusions. Manganese is also beneficial as an austenite stabilizer and, therefore, at least about 1% is preferred in the alloy.

Silicon can be present in the alloy but is a strong ferrite forming element and therefore is limited to no more than about 1.0% max., preferably to no more than 0.75% max. When present, silicon contributes to the weldability of the alloy by increasing fluidity of the alloy in the molten state. Accordingly, at least about 0.2% silicon is preferred in the alloy.

Carbon and nitrogen can be present in the alloy because they contribute to the stabilization of austenite in the alloy and to its solid solution strength. However, carbon and nitrogen are limited in order to avoid the formation of deleterious carbides, nitrides and/or carbonitrides at the grain boundaries when the alloy is heated. Such precipitates are undesirable because they adversely affect the impact strength and ductility of the alloy. Accordingly, carbon is limited to no more than about 0.10% max., preferably to no more than 0.08% max., and better yet to not more than 0.05% max. Nitrogen is limited to about 0.075% max., preferably to no more than 0.03% max. For best results nitrogen is limited to not more than about 0.015% max.

Molybdenum is present optionally in the alloy of the present invention. When present, molybdenum provides corrosion resistance, particularly to pitting attack in environments which contain chlorides or other halides. Accordingly, up to about 3.0%, preferably 1.5–2.5% molybdenum is present. Where the article according to the present invention is not contemplated for use in such aggressively corrosive environments, the molybdenum in the alloy can be limited to about 0.5% max.

Copper can also be present optionally in the alloy of this invention because it contributes to the corrosion resistance of the alloy and to stabilizing austenite in the alloy matrix. Accordingly, up to about 1% max. copper can be beneficial, but it is preferred that no more than about 0.5% max. be present.

Cobalt can be present in the alloy, but is limited when the alloy is intended for use in radioactive environments because in such environments cobalt can form radioactive isotopes which give off hazardous nuclear radiation. In this regard, up to about 0.2% max. cobalt can be present when the alloy is not intended for use inside a nuclear reactor. Cobalt is preferably limited to not more than about 0.1% max. when the alloy is to be used inside a nuclear reactor.

Sulfur is undesirable in the alloy because of the adverse effect on impact strength resulting from the formation of sulphides in the alloy. Accordingly, sulfur is limited to not more than about 0.010% max. and preferably to not more than 0.005% max. For best results, sulfur is limited to not more than about 0.002% max. Oxygen is also an undesirable element in the alloy used in this invention because of its adverse effect on the hot workability of the alloy due to oxide formation and accordingly, is kept as low as practicable.

The balance of the alloy used in the present invention is iron except for small amounts of one or more of the following elements. Up to about 0.045%, preferably up to about 0.025% phosphorous can be present. Up to about 0.2% tungsten and up to about 0.25% vanadium can also be present. Up to about 0.1% each of calcium, magnesium, aluminum, titanium and/or misch metal can also be present in the alloy used in this invention as residuals from deoxidizing and/or desulfurizing additions.

An article according to this invention is preferably made from the alloy by a powder metallurgy technique as follows. The alloy is first melted under vacuum and atomized by means of an inert atomizing fluid such a argon gas. The particle size of the prealloyed powder is not critical, but it is desirable to remove excessively large particles. Sifting the prealloyed powder through a 40 mesh screen for that purpose gives good results. Segregation of the powder by particle size can be advantageously minimized by blending the powder. Thus, before the powder material is placed in a container, it is thoroughly blended to obtain a uniform particle size distribution.

The blended powder is preferably baked to remove moisture prior to being loaded into a similarly baked canister for compaction. The baking temperature in air is preferably less than 400° F. to avoid oxidation. A baking temperature of 250° F. has provided good results. The dried powder is loaded into the canister which must be clean and essentially free of oxides. The canister material should be compatible with the alloy powder, preferably a low carbon, mild steel or an austenitic stainless steel such as AISI type 304 or 316 stainless steel.

When the canister is filled with the powder it is closed and then preferably evacuated to remove air and absorbed moisture. To this end the canister is preferably evacuated to less than 100 microns Hg. The canister can be heated during the evacuation process to facilitate the removal of moisture. When the air and water vapor levels inside the canister are satisfactory, evacuation is stopped and the canister is sealed and then compacted.

Hot isostatic pressing (HIP'ng) is the preferred method for compacting the metal powder. As is well known, the temperature, pressure, and the duration through which the material is held at temperature and pressure depend on the alloy powder and the canister size and shape and can be determined readily. The temperature to be used for a given composition must be below the incipient melting temperature of the alloy. The HIP'ng temperature is kept low, preferably about 2000°–2100° F. to limit growth of the boride precipitates. For an austenitic stainless steel canister having a 6 in diameter, 15 in length and 0.060 in wall thickness containing about 80 lb of the alloy powder, substantially full density was obtained by HIP'ng at 2100° F. and 15,000 psi for 2 h.

Although preparation of the alloy compact used in the present invention has been described with reference to a conventional powder metallurgy technique, it is contemplated that it can be prepared by other methods. For example, the simultaneous consolidation and reduction of metal powder disclosed in U.S. Pat. No. 4,693,863 could be utilized. Rapid solidification casting techniques are also applicable to the present invention. It is important that the method of preparation selected provide rapid cooling of the alloy from the molten state and that any intermediate consolidation steps be limited with respect to temperature, in order to limit the growth of the boride particles.

The alloy compact can be hot and/or cold worked to the desired article form. The powder metallurgy compact or other form of the alloy is mechanically hot worked from a temperature in the range of 1600°–2125° F., by pressing, hammering, rotary forging or flat rolling. A preferred method of hot working the material includes hot forging the ingot or compact from about 2125° F. followed by hot rolling from about 2125° F. to a flat form. The flat form can be cold rolled or ground to finish size as required. The final form of the article is preferably annealed at about 1900°–1950° F. for 30 minutes and rapidly quenched preferably in water.

The alloy when worked in accordance with the invention to form useful articles, is characterized by a uniform distribution of small boride particles within the alloy. The boride size and distribution is such as to provide a boride areal density per weight percent boron ($A_N$) defined by the relationship:

$$A_N \geqq 58{,}080 - 18{,}130\ (\%\ B).$$

Stated another way, $A_N$ represents the areal density of boride particles normalized with respect to the boron content. The term "areal density" is defined to mean the number of borides per square millimeter as determined by optical image analysis on a metallographic specimen prepared in accordance with good grinding and polishing practice. The unique combination of tensile ductility, strength and impact strength provided by the alloy of the present invention and articles made therefrom is directly related to this normalized areal density of borides. The normalized areal density for a given composition is represented by the ratio: Areal Density ÷ % Boron. As previously discussed the method of preparing and mechanically working the alloy is not critical as long as the borides are formed with a uniformly fine distribution and are not permitted to grow to the extent that the normalized, boride areal density does not meet the above-stated relationship.

Sufficient reduction in area of the powder compact or other form of the alloy during mechanical working is also necessary to provide the superior impact strength which is characteristic of the alloy according to this invention. In this regard the alloy is mechanically reduced so as to provide a room temperature Charpy V-notch impact strength defined by the relationship $$CVN \geqq 85.917x\ e^{-1.20297}(\%\ B).$$

Preferably, the mechanically worked alloy of the present invention has a room-temperature Charpy V-notch impact strength defined by the relationship $$CVN \geqq 90.396x\ e^{-1.16702}(\%\ B).$$

Better yet the impact strength of the as-worked alloy can be defined by the relationship $$CVN \geqq 106.20x\ e^{-0.90942}(\%\ B).$$

Charpy V-notch impact strength is intended to mean that determined in accordance with ASTM Standard E23 with a standard size V-notch specimen as set forth therein.

In order to attain the foregoing levels of impact strength, overall reduction by mechanical working should be at least about 85%, and preferably at least about 90%. For best results, overall mechanical reduction of the alloy should be at least about 95%.

The present invention is directed to providing a variety of product forms for structural applications such as strip, sheet, plate, bar, as well as non-structural product forms. The present invention is particularly suited for the production of flat rolled products as mentioned above which in turn can be fabricated into finished forms such as channel and angle. Articles made in accordance with the invention are particularly suitable for use in the nuclear industry where a combination of good neutron absorption and high structural strength and toughness are required. Examples of such applications include nuclear fuel storage racks as well as casks for transporting nuclear waste material. Moreover, the minimum normalized areal density of borides provided by the alloy according to the invention and present in articles made therefrom, ensures consistent attainment of the unique combination of neutron absorption, strength, ductility, impact toughness and corrosion resistance characteristic of this invention.

EXAMPLES

Example heats 1–7 within the claimed invention and comparative heats A-G outside the claimed invention having the analyses shown in Table I were prepared as follows. Analyses are given in weight percent unless otherwise specified.

TABLE I

| Ex. | C | Mn | Si | P | S | Cr | Ni | Mo | Cu | B | N | O* | Fe |
|---|---|---|---|---|---|---|---|---|---|---|---|---|---|
| 1 | .019 | 1.51 | .55 | <.015 | .002 | 18.67 | 13.59 | <.01 | .01 | .45 | .006 | 208 | Bal. |
| 2 | .020 | 1.69 | .53 | <.015 | .002 | 18.54 | 13.58 | <.01 | .01 | .72 | .004 | 160 | Bal. |
| 3 | .032 | 1.76 | .55 | <.015 | .002 | 18.60 | 13.52 | <.01 | .02 | .97 | .004 | 198 | Bal. |
| 4 | .040 | 1.78 | .58 | <.015 | .002 | 18.43 | 13.63 | <.01 | .02 | 1.20 | .007 | 239 | Bal. |
| 5 | .040 | 1.80 | .56 | <.015 | .002 | 18.54 | 13.73 | <.01 | .02 | 1.48 | .008 | 227 | Bal. |
| 6 | .044 | 1.80 | .58 | <.015 | .002 | 18.51 | 13.70 | <.01 | .02 | 1.75 | .008 | 145 | Bal. |
| 7 | .065 | 1.80 | .55 | <.015 | .002 | 18.59 | 13.57 | <.01 | .02 | 2.03 | .008 | 147 | Bal. |
| A | .017 | 1.60 | .53 | <.015 | .002 | 18.07 | 12.83 | .01 | .01 | .48 | .003 | 30 | Bal. |
| B | .018 | 1.60 | .53 | <.015 | .002 | 17.95 | 12.84 | .01 | .01 | .74 | .004 | 20 | Bal. |
| C | .040 | 1.64 | .55 | <.015 | .004 | 18.38 | 13.61 | <.01 | .01 | 1.03 | .001 | 20 | Bal. |
| D | .034 | 1.70 | .52 | <.015 | .002 | 18.46 | 13.46 | .01 | .03 | 1.28 | .001 | 10 | Bal. |
| E | .034 | 1.70 | .54 | <.015 | .002 | 18.53 | 13.46 | .01 | .03 | 1.54 | .002 | 20 | Bal. |
| F | .035 | 1.70 | .52 | <.015 | .002 | 18.48 | 13.32 | .01 | .03 | 1.73 | .003 | 20 | Bal. |
| G | .034 | 1.71 | .52 | <.015 | .002 | 18.58 | 13.28 | .01 | .03 | 1.98 | .003 | 10 | Bal. |

*Oxygen content in ppm.

Heats 1–7 were prepared by powder metallurgy. In this regard argon atomized, prealloyed powder was screened to −40 mesh, blended and then baked at 250° F. to remove moisture. Approximately 80 lb. of the baked metal powder from each heat was loaded into a stainless steel canister having the dimensions: 6 in diam x 15 in long x 0.060 in wall thickness. Each canister was closed and evacuated to less than about 100 micron Hg and then sealed. The canisters were hot isostatically pressed at 2100° F. and 15,000 psi for 2 h.

Heats A–G were prepared by vacuum induction melting (VIM) and cast as 4½ in square ingots.

The powder compacts of heats 1–7 and the cast ingots of heats A-G were forged from 2125° F. to 1½ in x 4 in bars. All of the forged bars were hot rolled from 2125° F. to form ⅝ in x 4½ in flat bars. The hot rolled bars were annealed at 1950° F. for 30 min and water quenched. Standard size, transverse tensile and Charpy V-notch impact specimens were machined from each of the hot rolled bars.

The results of room temperature and 662° F. (350° C.) tensile tests respectively are shown in Tables IIA and IIB including 0.2% yield strength (Y.S.) and ultimate tensile strength (U.T.S.) in ksi, the percent elongation in four diameters (% El.) and the percent reduction in cross-sectional area (% R.A.). The values for each quantity represent the average of four tests at each temperature. The data are presented with the corresponding boron content shown in weight percent (% B).

TABLE IIA

| | | (ROOM TEMPERATURE) | | | |
|---|---|---|---|---|---|
| Ex. | % B | Y.S. | U.T.S | % El. | % R.A. |
| 1 | 0.45 | 34.7 | 90.1 | 43.9 | 64.3 |
| 2 | 0.72 | 37.9 | 93.7 | 39.1 | 59.7 |
| 3 | 0.97 | 40.5 | 98.5 | 36.3 | 56.3 |
| 4 | 1.20 | 42.0 | 103.0 | 31.7 | 51.8 |
| 5 | 1.48 | 47.6 | 107.1 | 28.3 | 45.1 |
| 6 | 1.75 | 48.3 | 110.2 | 23.7 | 36.5 |
| 7 | 2.03 | 51.3 | 115.9 | 21.1 | 31.2 |
| A | 0.48 | 35.0 | 87.5 | 40.4 | 51.9 |
| B | 0.74 | 39.1 | 90.0 | 32.9 | 41.0 |
| C | 1.03 | 41.2 | 93.2 | 24.3 | 32.6 |
| D | 1.28 | 42.4 | 94.2 | 21.4 | 20.6 |
| E | 1.54 | 45.2 | 92.9 | 17.2 | 16.7 |
| F | 1.73 | 46.8 | 93.5 | 13.1 | 15.4 |
| G | 1.98 | 50.1 | 95.7 | 11.9 | 15.2 |

TABLE IIB

| | | (662° F. (350° C.)) | | | |
|---|---|---|---|---|---|
| Ex. | % B | Y.S. | U.T.S | % El. | % R.A. |
| 1 | 0.45 | 32.1 | 68.0 | 29.3 | 59.9 |

TABLE IIB-continued

| | | (662° F. (350° C.)) | | | |
|---|---|---|---|---|---|
| Ex. | % B | Y.S. | U.T.S | % El. | % R.A. |
| 2 | 0.72 | 35.1 | 70.4 | 27.4 | 55.4 |
| 3 | 0.97 | 37.9 | 77.8 | 25.7 | 51.3 |
| 4 | 1.20 | 41.3 | 83.6 | 24.1 | 43.9 |
| 5 | 1.48 | 45.9 | 88.3 | 21.5 | 42.2 |
| 6 | 1.75 | 49.9 | 90.9 | 17.8 | 31.3 |
| 7 | 2.03 | 46.3 | 101.1 | 15.2 | 21.8 |
| A | 0.48 | 30.0 | 67.6 | 27.8 | 49.2 |
| B | 0.74 | 34.6 | 71.2 | 21.6 | 40.1 |
| C | 1.03 | 36.4 | 78.7 | 19.4 | 26.3 |
| D | 1.28 | 38.1 | 78.3 | 16.1 | 24.0 |
| E | 1.54 | 38.6 | 80.9 | 14.2 | 22.7 |
| F | 1.73 | 40.8 | 80.5 | 12.1 | 18.6 |
| G | 1.98 | 46.5 | 83.2 | 11.2 | 15.8 |

Tables IIA and IIB show the significantly better combination of tensile strength and ductility of the compositions made in accordance with the invention at each level of boron compared to the other compositions at corresponding levels of boron.

The results of room temperature, 662° F. (350° C.) and −20° F. (−29° C.) impact toughness tests are shown in Table III as Charpy V-notch impact strength (CYN) in ft-lb. The values given represent the average of four tests for the room temperature data, and the average of three tests for the 662° F. (350° C.) and −20° F. (−29° C.) data.

TABLE III

| | | CVN | | |
|---|---|---|---|---|
| Ex. | % B | RT | 662° F. (350° C.) | −20° F. (−29° C.) |
| 1 | 0.45 | 70 | 72 | 64 |
| 2 | 0.72 | 54 | 56 | 52 |
| 3 | 0.97 | 44 | 45 | 43 |
| 4 | 1.20 | 36 | 38 | 35 |
| 5 | 1.48 | 29 | 30 | 30 |
| 6 | 1.75 | 22 | 25 | 24 |
| 7 | 2.03 | 16 | 18 | 17 |
| A | 0.48 | 46 | 49 | 41 |
| B | 0.74 | 23 | 27 | 26 |
| C | 1.03 | 16 | 16 | 16 |
| D | 1.28 | 11 | 14 | 12 |
| E | 1.54 | 8 | 10 | 8 |
| F | 1.73 | 6 | 9 | 6 |
| G | 1.98 | 5 | 6 | 5 |

The data of Table III show the significantly higher impact strength of the compositions within the present invention at each level of boron compared to the other compositions at corresponding boron levels. Moreover, when the data in Table III are read in connection with the data in Tables IIA and IIB, it is apparent that the examples of the present invention have a superior combination of tensile strength and impact strength. The superiority of the examples according to the invention over the conventional material with respect to the combination of tensile strength and impact strength is clearly shown in the drawing. The drawing shows graphically the room temperature impact strength results for Examples 1–7 and A–G of Table III vs. the room temperature tensile strength results of Table IIA.

The results of metallographic evaluation of transverse sections of each example by image analysis are shown in Table IV including the volume percent of borides (Vol. %), the boride areal density (Areal Dens.) as the number of borides per $mm^2$, the average boride length (Ave. lgth.) in $\mu m$, the average boride area (Ave. Area) in $\mu m^2$, the mean spacing between borides (Mn. Sp.) in $\mu m$, and the mean free path (MFP) in $\mu m$. Image analysis was performed using a Leitz, Model TAS Plus automatic image analyzer with a 50X objective lens and a screen magnification of 1640X. The values given were determined by scanning 100 fields, each of which were 18,215 $\mu m^2$ in area.

TABLE IV

| Ex. | Vol. % | Areal Density | Avg. Lgth. | Avg. Area | Mn. Sp. | M.F.P. |
|---|---|---|---|---|---|---|
| 1 | 2.98 | 28,493 | 1.05 | 1.05 | 33.51 | 32.51 |
| 2 | 7.09 | 39,794 | 1.43 | 1.78 | 17.65 | 16.39 |
| 3 | 9.94 | 44,730 | 1.62 | 2.22 | 13.78 | 12.41 |
| 4 | 12.51 | 48,209 | 1.78 | 2.60 | 11.65 | 10.19 |
| 5 | 15.98 | 51,564 | 1.99 | 3.10 | 9.77 | 8.21 |
| 6 | 20.42 | 50,799 | 2.33 | 4.02 | 8.45 | 6.72 |
| 7 | 23.60 | 50,034 | 2.60 | 4.72 | 7.70 | 5.88 |
| A | 3.06 | 16,645 | 1.96 | 1.84 | 30.94 | 30.00 |
| B | 4.90 | 16,540 | 2.65 | 2.96 | 23.01 | 21.88 |
| C | 7.08 | 18,617 | 3.10 | 3.80 | 17.52 | 16.28 |
| D | 9.89 | 25,384 | 3.06 | 3.90 | 13.02 | 11.73 |
| E | 12.15 | 27,691 | 3.27 | 4.39 | 11.53 | 10.13 |
| F | 17.44 | 23,570 | 4.95 | 7.40 | 9.01 | 7.44 |
| G | 28.96 | 16,481 | 7.63 | 17.57 | 8.07 | 5.73 |

Table IV shows that examples 1–7 have significantly higher boride areal densities than the corresponding examples A–G. It is noted that examples 1–7 generally have smaller borides than the corresponding examples A–G as evidenced by the shorter average boride lengths and smaller average boride areas. No significant difference is shown for the volume percent of borides, the boride mean spacing and the mean free path between the two sets of examples, however.

The normalized areal density ($A_N$) for each of the examples 1–7 and A–G is shown in Table V. As previously indicated the normalized areal density is the areal density normalized with respect to the weight percent of boron and is represented by the ratio: areal density ÷ % boron.

TABLE V

| Ex. | % B | $A_N$ | Ex. | % B | $A_N$ |
|---|---|---|---|---|---|
| 1 | 0.45 | 63,318 | A | 0.48 | 34,677 |
| 2 | 0.72 | 55,269 | B | 0.74 | 22,351 |
| 3 | 0.97 | 46,113 | C | 1.03 | 18,075 |
| 4 | 1.20 | 40,174 | D | 1.28 | 19,831 |
| 5 | 1.48 | 34,841 | E | 1.54 | 17,981 |
| 6 | 1.75 | 29,028 | F | 1.73 | 13,624 |
| 7 | 2.03 | 24,647 | G | 1.98 | 8,324 |

The data of Table V show that the examples according to the invention have a significantly higher normalized areal density of borides compared to the other examples, as is characteristic of articles of the present invention. Given the similarities in composition and mechanical working between the corresponding examples it is clear that the superior combination of mechanical properties of the examples of the invention are directly related to the higher normalized boride areal density.

The terms and expressions which have been employed are used as terms of description and not of limitation. There is no intention in the use of such terms and expressions to exclude any equivalents of the features described and shown, or portions thereof. It is recognized, however, that various modifications are possible within the scope of the invention claimed.

What is claimed is:

1. An article formed of an austenitic stainless steel alloy consisting essentially of, in weight percent, about

| | w/o |
|---|---|
| Carbon | 0.10 max. |
| Manganese | 2.00 max. |
| Silicon | 1.00 max. |
| Phosphorus | 0.045 max. |
| Sulfur | 0.010 max. |
| Chromium | 16.00–22.00 |
| Nickel | 10.00–15.00 |
| Molybdenum | 0–3.0 |
| Boron | 0.2–2.0 |
| Nitrogen | 0.075 max. |

and the balance consisting essentially of iron, said article having a boride particle areal density per weight percent boron ($A_N$) defined by the relationship $$A_N \geqq 58{,}080 - 18{,}130\ (\%\ B)$$

and said article further having a Charpy V-notch impact strength (CVN) defined by the relationship $$CVN \geqq 85.917 \times e^{-1.20297}(\%\ B).$$

2. An article as set forth in claim 1 wherein the alloy contains not more than about 0.005% max. sulfur.

3. An article as set forth in claim 2 wherein the alloy contains not more than about 0.03% max. nitrogen.

4. An article as set forth in claim 3 wherein the alloy contains not more than about 1.8% boron.

5. An article as set forth in claim 1 wherein the alloy contains at least about 10.50% nickel.

6. An article as set forth in claim 5 wherein the alloy contains about 18.00–20.00% chromium.

7. An article as set forth in claim 1 having a Charpy V-notch impact strength (CVN) defined by the relationship $$CYN \geqq 90.396 \times e^{-1.16702}(\%\ B).$$

8. An article as set forth in claim 3 having a Charpy V-notch impact strength (CVN) defined by the relationship $$CVN \geqq 106.20 \times e^{-0.90942}(\%\ B).$$

9. A mechanically worked article formed of an austenitic stainless steel alloy consisting essentially of, in weight percent, about

| | w/o |
|---|---|
| Carbon | 0.08 max. |
| Manganese | 2.00 max. |

-continued

| | w/o |
|---|---|
| Silicon | 0.75 max. |
| Phosphorus | 0.045 max. |
| Sulfur | 0.005 max. |
| Chromium | 16.00–22.00 |
| Nickel | 10.50–15.00 |
| Molybdenum | 2.5 max. |
| Boron | 0.2–1.8 |
| Nitrogen | 0.03 max. |

and the balance consisting essentially of iron, said article having a boride particle areal density per weight percent boron ($A_N$) defined by the relationship $$A_N \geqq 58{,}080 - 18{,}130\ (\%\ B);$$

and said article further having a Charpy V-notch impact strength (CVN) defined by the relationship $$CVN \geqq 90.396 \times e^{-1.16702}(\%\ B).$$

10. A mechanically worked article as set forth in claim 9 wherein the alloy contains not more than about 0.002% max. sulfur.

11. A mechanically worked article as set forth in claim 10 wherein the alloy contains not more than about 0.015% nitrogen.

12. A mechanically worked article as set forth in claim 11 wherein the alloy contains not more than about 1.6% boron.

13. A mechanically worked article as set forth in claim 9 wherein the alloy contains at least about 12.00% nickel.

14. A mechanically worked article as set forth in claim 13 wherein the alloy contains about 18.00–20.00% chromium.

15. A mechanically worked article as set forth in claim 9 having a Charpy V-notch impact strength (CVN) defined by the relationship $$CVN \geqq 106.20 \times e^{-0.90942}(\%\ B.)$$

16. In a process for making a boron containing stainless steel article the steps of melting an alloy consisting essentially of in weight percent about

| | w/o |
|---|---|
| Carbon | 0.10 max. |
| Manganese | 2.00 max. |
| Silicon | 1.00 max. |
| Phosphorus | 0.045 max. |
| Sulfur | 0.010 max. |
| Chromium | 16.00–22.00 |
| Nickel | 10.00–15.00 |
| Molybdenum | 0–3.0 |
| Boron | 0.2–2.0 |
| Nitrogen | 0.075 max. |
| Iron | Bal.; |

consolidating said alloy at a temperature below the incipient melting temperature of said alloy such that the growth of boride particles in said alloy is limited, and mechanically working the consolidated alloy to provide a boride particle areal density per weight percent boron ($A_N$) defined by the relationship $$A_N \geqq 58{,}080 - 18{,}130\ (\%\ B).$$

17. A process as set forth in claim 16 wherein the step of mechanically working the alloy comprises the step of reducing the cross-sectional area of the consolidated alloy by at least about 85%.

18. A process as set forth in claim 16 wherein the step of consolidating the alloy comprises the steps of atomizing the molten alloy to form an alloy powder, and compacting the alloy powder to substantially full density.

19. A process as set forth in claim 17 wherein the step of reducing the cross-sectional area is accomplished by flat rolling the alloy.

20. A process as set forth in claim 19 wherein the alloy is flat rolled to provide a Charpy V-notch impact strength (CVN) defined by the relationship $$CVN \geqq 85.917 \times e^{-1.20297}(\%\ B).$$

* * * * *